US005251604A

United States Patent [19]

Kaneko et al.

[11] Patent Number: 5,251,604

[45] Date of Patent: Oct. 12, 1993

[54] SYSTEM AND METHOD FOR DETECTING DETERIORATION OF OXYGEN SENSOR USED IN FEEDBACK TYPE AIR-FUEL RATIO CONTROL SYSTEM OF INTERNAL COMBUSTION ENGINE

[75] Inventors: Hiroaki Kaneko; Kouichi Nemoto; Akihide Okada, all of Kanagawa, Japan

[73] Assignee: Nissan Motor Company, Ltd., Japan

[21] Appl. No.: 713,230

[22] Filed: Jun. 11, 1991

[30] Foreign Application Priority Data

Jun. 19, 1990 [JP] Japan ..... 2-158664

[51] Int. Cl.[5] ..... F02D 41/14

[52] U.S. Cl. ..... 123/688; 123/691; 123/695

[58] Field of Search ..... 123/688, 690, 691, 694, 123/695

[56] References Cited

U.S. PATENT DOCUMENTS

| | | | |
|---|---|---|---|
| 4,117,815 | 10/1978 | Ikeura | 123/691 |
| 4,337,746 | 7/1982 | Masaki | 123/691 |
| 4,854,288 | 8/1989 | Uchikawa | 123/691 X |
| 4,915,080 | 4/1990 | Nakaniwa et al. | 123/691 |
| 5,025,767 | 6/1991 | Kume et al. | 123/691 |
| 5,065,728 | 11/1991 | Nakaniwa | 123/694 X |
| 5,095,878 | 3/1992 | Kumagai et al. | 123/691 X |

FOREIGN PATENT DOCUMENTS

| | | | |
|---|---|---|---|
| 58-47248 | 3/1983 | Japan . | |
| 59-215935 | 12/1984 | Japan . | |
| 139943 | 6/1987 | Japan | 123/691 |

*Primary Examiner*—Willis R. Wolfe

*Attorney, Agent, or Firm*—Lowe, Price, LeBlanc & Becker

[57] ABSTRACT

A feedback type air-fuel ratio control system controls the air-fuel ratio of air-fuel mixture fed to an internal combustion engine in accordance with an information signal issued from a first oxygen sensor installed in an exhaust line of the engine. The exhaust line has a catalytic converter at a position downstream of the first oxygen sensor. There is further provided a system in the control system, which detects deterioration of the first oxygen sensor. The system comprises a computer and a second oxygen sensor of delayed response type installed in the exhaust line at a position upstream of the converter. The computer defines higher and lower slice levels with respect to the output of the second oxygen sensor and compares the output of the second oxygen sensor with the higher and lower slice levels.

10 Claims, 11 Drawing Sheets

SYSTEM AND METHOD FOR DETECTING DETERIORATION OF OXYGEN SENSOR USED IN FEEDBACK TYPE AIR-FUEL RATIO CONTROL SYSTEM OF INTERNAL COMBUSTION ENGINE

BACKGROUND OF THE INVENTION

1. Field of the Invention

The present invention relates to a system and a method for detecting deterioration of an oxygen sensor, and more particularly, to a system and a method for detecting deterioration of an oxygen sensor used in a feedback type air-fuel ratio control system of an internal combustion engine.

2. Description of the Prior Art

Japanese Patent First Provisional Publications Nos. 58-47248 and 59-215935 show conventional feedback type air-fuel ratio control systems for an internal combustion engine. In these systems, a basic fuel injection quantity is calculated based on various engine operation informations, such as, intake air amount, engine speed and the like, and the basic fuel injection quantity is corrected in accordance with an information signal issued from an oxygen sensor installed in an exhaust gas conduit. The amount of fuel practically fed to the engine is controlled in accordance with the corrected fuel injection quantity. This control is repeated in a feedback manner for keeping the air-fuel ratio of air-fuel mixture within a desirable or stoichiometric level.

FIG. 16 shows a block diagram of the conventional air-fuel ratio control system of feedback type.

Designated by reference "A" is a computer-installed control unit. A basic pulse is produced from signals respectively issued from an air-flow meter and an ignition coil. The basic pulse is weighted by an information signal from a throttle valve switch and corrected in voltage by a battery. Furthermore, the pulse is weighted, through an air-fuel ratio feedback control circuit "B", by an information signal issued from an oxygen sensor 1 and weighted by information signals respectively issued from a start switch and a coolant temperature sensor. The corrected signal is then treated by an arithmetic circuit and amplified by a power amplifier to practically actuate fuel injectors.

FIG. 17 shows the detail of the air-fuel ratio feedback control circuit "B" shown in FIG. 16. When the electromotive force of the oxygen sensor 1 is higher than a reference voltage, it is judged that the air-fuel mixture practically fed to the engine is richer than stoichiometric. Upon this, the circuit "B" adds a so-called "mixture leaning signal" to the basic signal for controlling the fuel injectors to inject smaller amount of fuel. While, when the electromotive force is lower than the reference voltage, it is judged that the air-fuel mixture fed to the engine is leaner than stoichiometric. Upon this, the circuit "B" adds a so-called "mixture enrichment signal" to the basic signal for controlling the fuel injectors to inject larger amount of fuel. In fact, the amount of fuel injected by the fuel injectors is controlled by varying the time during which the injectors are opened.

FIG. 18 is a chart showing an output signal V' of the oxygen sensor 1 on the axis of ordinates and elapsed time on the axis of abscissas. FIG. 19 is a graph showing an air-fuel ratio correction factor ($\alpha$) on the axis of the ordinates and elapsed time on the axis of abscissas. It is to be noted that proportional factors PR and PL and integral factors IR and IL shown in FIG. 19, which are the correction factors, are all constant.

Under the above-mentioned control, a catalytic converter (particularly, three-way type catalytic converter) can exhibit high performance in purifying the exhaust gas from the engine. However, hitherto, the above-mentioned conventional air-fuel ratio control system has been constructed without taking a severe consideration on deterioration of the oxygen sensor which appears with passing of time. In fact, the output characteristic of the oxygen sensor changes with the lapse of time. Thus, after prolonged usage of the system, the stoichiometrically controlled feeding of air-fuel mixture to the engine becomes out of order due to the deterioration of the oxygen sensor and thus the exhaust gas from the engine fails to have an exhaust composition which is suitable for allowing the catalytic converter to exhibit its maximum performance.

SUMMARY OF THE INVENTION

It is therefore an object of the present invention to provide a system and a method for detecting deterioration of an oxygen sensor which is operatively used in an air-fuel ratio control system of an internal combustion engine.

According to a first aspect of the present invention, there is provided a combination in a feedback type air-fuel ratio control system which controls the air-fuel ratio of air-fuel mixture fed to an internal combustion engine in accordance with an information signal issued from a first oxygen sensor installed in an exhaust line of the engine. The exhaust line has a catalytic converter mounted thereto at a position downstream of the first oxygen sensor. The combination comprises a second oxygen sensor installed in the exhaust line at a position upstream of the catalytic converter, the second oxygen sensor being of a delayed response type; first means for defining higher and lower slice levels with respect to the output of the second oxygen sensor; and second means for detecting deterioration of the first oxygen sensor by comparing the output of the second oxygen sensor with the higher and lower slice levels.

According to a second aspect of the present invention, there is provided, in a feedback type air-fuel ratio control system which controls the air-fuel ratio of air-fuel mixture fed to an internal combustion engine in accordance with an information signal issued from a first oxygen sensor installed in an exhaust line of the engine at a position downstream of the first oxygen sensor, a method for detecting deterioration of the first oxygen sensor. The method comprises by steps monitoring the air-fuel ratio of the mixture by receiving an information signal from a second oxygen sensor installed in the exhaust line at a position upstream of the catalytic converter, the second oxygen sensor being of a delayed response type; defining higher and lower slice levels with respect to the output of the second oxygen sensor; and comparing the output of the second oxygen sensor with the higher and lower slice levels.

According to a third aspect of the present invention, there is provided a feedback type air-fuel ratio control system of an internal combustion engine which is equipped with a catalytic converter at an exhaust line. The system comprises a first oxygen sensor installed in the exhaust line at a position upstream of the catalytic converter; control means for controlling the air-fuel ratio of air-fuel mixture fed to the engine in accordance with an information signal issued from the first oxygen sensor; a second oxygen sensor installed in the exhaust line at a position upstream of the catalytic converter, the second oxygen sensor being of a delayed response type; first means for defining higher and lower slice levels with respect to the output of the second oxygen sensor; second means for detecting deterioration of the first oxygen sensor by comparing the output of the second oxygen sensor with the higher and lower slice levels; and third means for modifying the information signal of the first oxygen sensor in accordance with an information from the second means.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
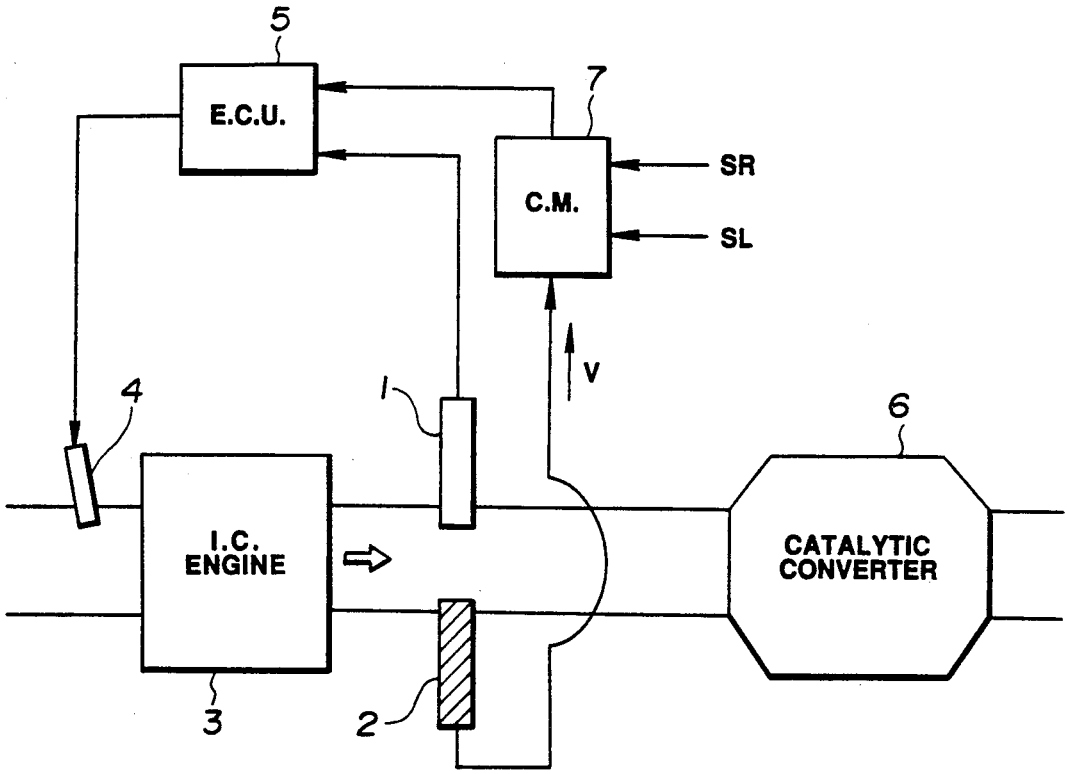
FIG. 1 is a schematic block diagram of an air-fuel ratio control system of an internal combustion engine to which the present invention is practically applied.

FIG. 1 shows, but schematically, an air-fuel ratio control system of an internal combustion engine to which the present invention is practically applied. Denoted by numeral 1 is a first oxygen sensor, 2 is a second oxygen sensor, 3 is an internal combustion engine, 4 is a fuel injection valve, 5 is an electronic controlling unit and 6 is a catalytic converter.

As the first oxygen sensor 1, commonly used sensors, such as, solid electrolyte type, oxide semiconductor type, limiting current type and the like are usable.

Figure 2:
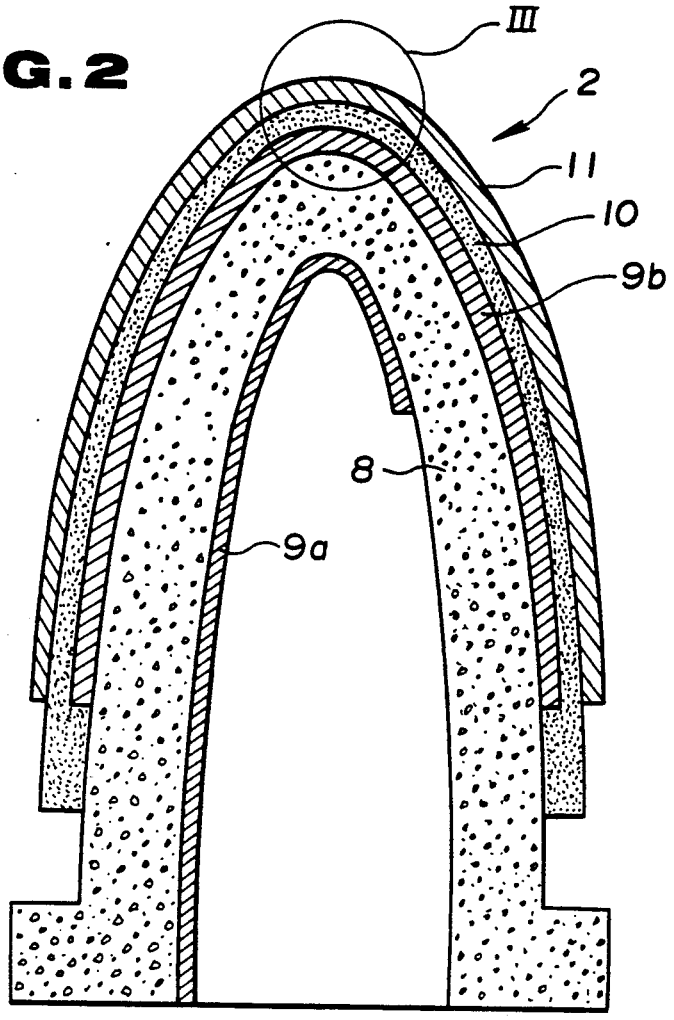
FIG. 2 is a sectional view of an oxygen sensor which is used as a second oxygen sensor in the present invention.
Figure 3:
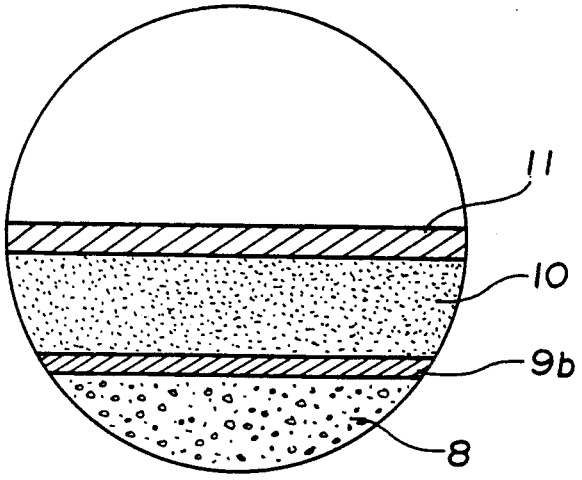
FIG. 3 is an enlarged view of the part enclosed by the circle "III" in FIG. 2.

As the second oxygen sensor 2, such an oxygen sensor as shown in FIGS. 2 and 3 is used.

The sensor 2 comprises a conical structure 8 of zirconia, first and second platinum electrodes 9*a* and 9*b* lined on inner and outer surfaces of the conical zirconia structure 8, a spinel layer 10 lined on the second electrode 9*b* and a catalyst layer 11 lined on the spinel layer. The catalyst layer 11 includes noble metals and ceria.

With this catalyst layer 11, the second oxygen sensor 2 has a so-called "delayed response characteristic".

During operation of the engine 3 (see FIG. 1), the first oxygen sensor 1 feeds the electronic controlling unit 5 with an information signal which represents the oxygen concentration in the exhaust gas from the engine 3. In accordance with the information signal, the controlling unit 5 controls the fuel injection valve 4 to increase or decrease fuel injected therefrom, so that the air-fuel mixture practically fed to the engine 3 has a desired or stoichiometric air-fuel ratio.

In accordance with the present invention, monitoring system is further employed, which monitors whether the air-fuel mixture fed to the engine 3 is controlled within a stoichiometric level or not. Thus, the monitoring system can detect the deterioration of the first oxygen sensor 1. That is, the monitoring system is so designed as to judge whether an average air-fuel ratio of the mixture is within the stoichiometric level or not.

The monitoring system includes the second oxygen sensor 2 and a comparative means 7.

Figure 4:
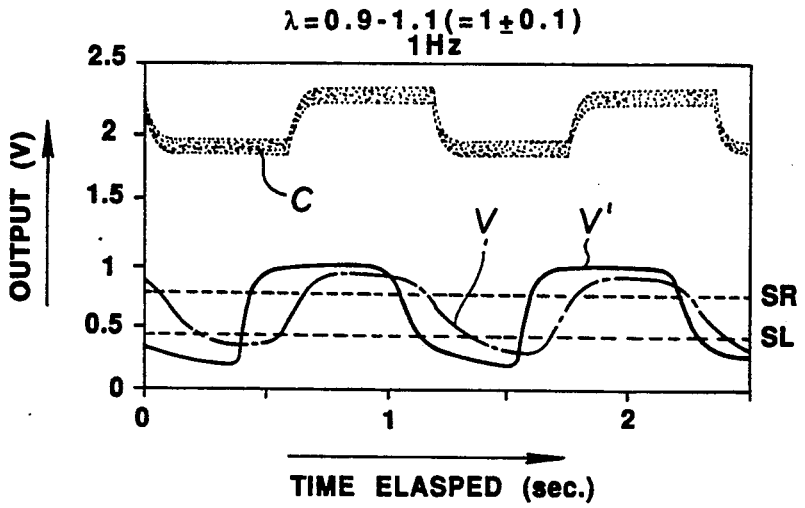
FIGS. 4 to 6 are charts showing the output characteristics of first and second oxygen sensors.
Figure 5:
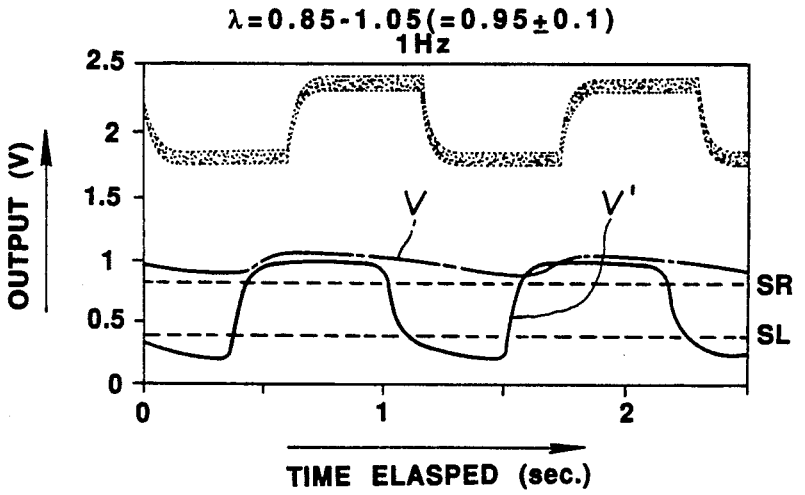
Figure 6:
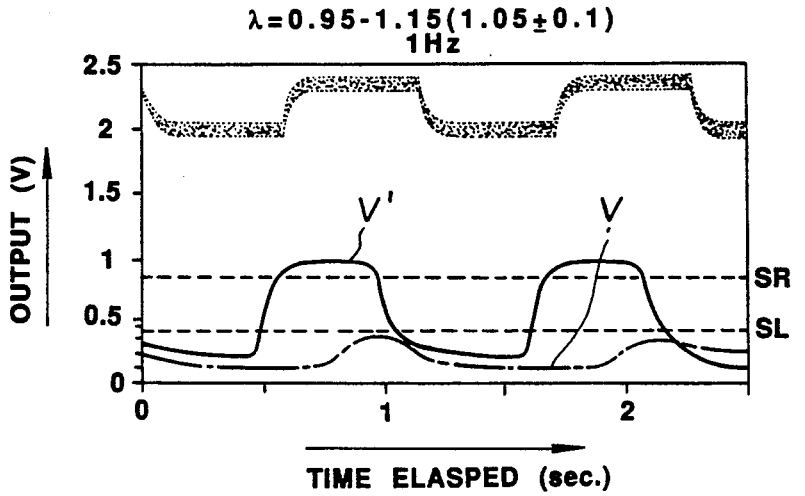
Figure 7:
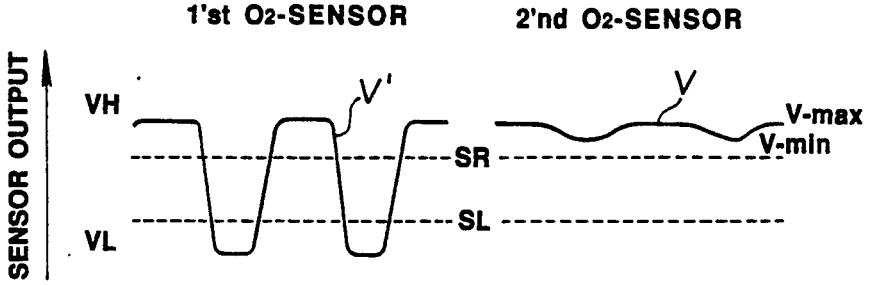
FIGS. 7 to 11 are charts showing output characteristics of the first and second oxygen sensors in various conditions.
Figure 8:
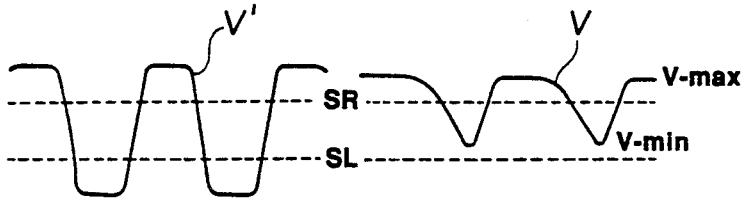

The output characteristic of the second oxygen sensor 2 is shown by a phantom line in the charts of FIGS. 4 to 6. For comparison, the output characteristic of the first oxygen sensor 1 is shown by a solid line in the charts.

As is seen from FIG. 4, when the second oxygen sensor 2 is exposed to an exhaust gas which is produced from an air-fuel mixture having a stoichiometric or its neighboring air-fuel ratio, the output of the second oxygen sensor 2 exhibits an output characteristic similar to that of the first oxygen sensor 1.

However, as is seen from FIG. 5, when the exhaust gas is inclined toward a richer side (that is, when the air-fuel mixture becomes richer), the output of the second oxygen sensor 2 exhibits a richer characteristic, and as is seen from FIG. 6, when the exhaust gas is inclined toward a leaner side (that is, when the air-fuel mixture becomes leaner), the output of the second oxygen sensor 2 exhibits a leaner characteristic.

This unique output characteristic of the sensor 2 is caused by presence of ceria contained therein, as is described in Japanese Patent Application No. 2-17910 filed by the same applicants.

It is to be noted that in the charts of FIGS. 4 to 6, "λ" is the excessive air factor which is defined by dividing the quantity of air supplied to the engine by the theoretical requirement, "V" is the output curve of the second oxygen sensor 2, "V'" is the output curve of the first oxygen sensor 1 and "C" is a control pattern.

As is shown in FIGS. 7 to 11, when the second oxygen sensor 2 having the above-mentioned output characteristic is practically used, slice levels SR and SL are provided at richer output side and leaner output side respectively.

Figure 9:
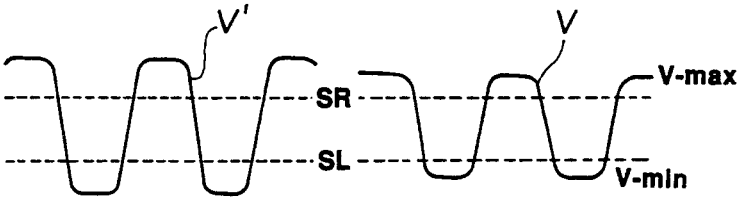
Figure 10:
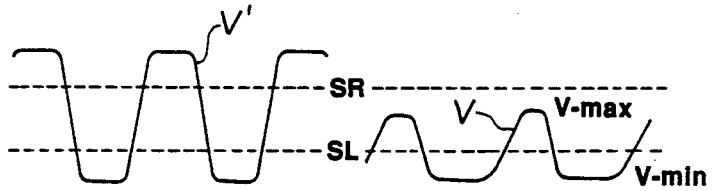
Figure 11:
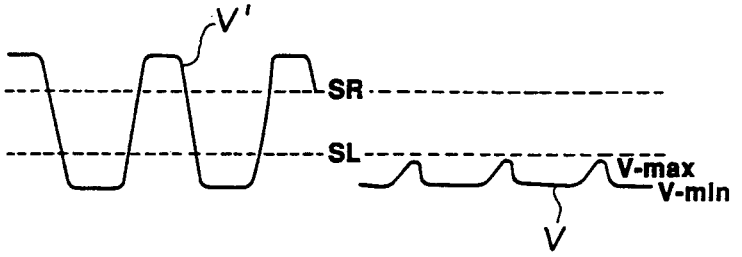

That is, when, as is seen from the chart of FIG. 9, the curve of the output "V" of the second oxygen sensor 2 intersects both the slice levels SR and SL, it is judged that the air-fuel ratio of the air-fuel mixture is desirable. When, as is understood from the chart of FIG. 7, the curve of the output "V" is located at a richer side and fails to intersect both the slice levels "SR" and "SL", it is judged that the air-fuel ratio of the mixture is richer than stoichiometric, and when, as is understood from the chart of FIG. 8, the curve of the output "V" intersects only the slice level "SR", it is judged that the air-fuel ratio of the mixture is slightly richer than stoichiometric. When, as is seen from the chart of FIG. 10, the curve of the output "V" intersects only the slice level "SL", it is judged that the air-fuel ratio of the mixture is slightly leaner than stoichiometric, and when, as is seen from the chart of FIG. 11, the curve of the output "V" is located at the leaner side and fails to intersect both the slice levels "SL" and "SR", it is judged that the air-fuel ratio of the mixture is leaner than stoichiometric.

With this, it is possible to detect the deterioration of the first oxygen sensor 1.

Figure 12:
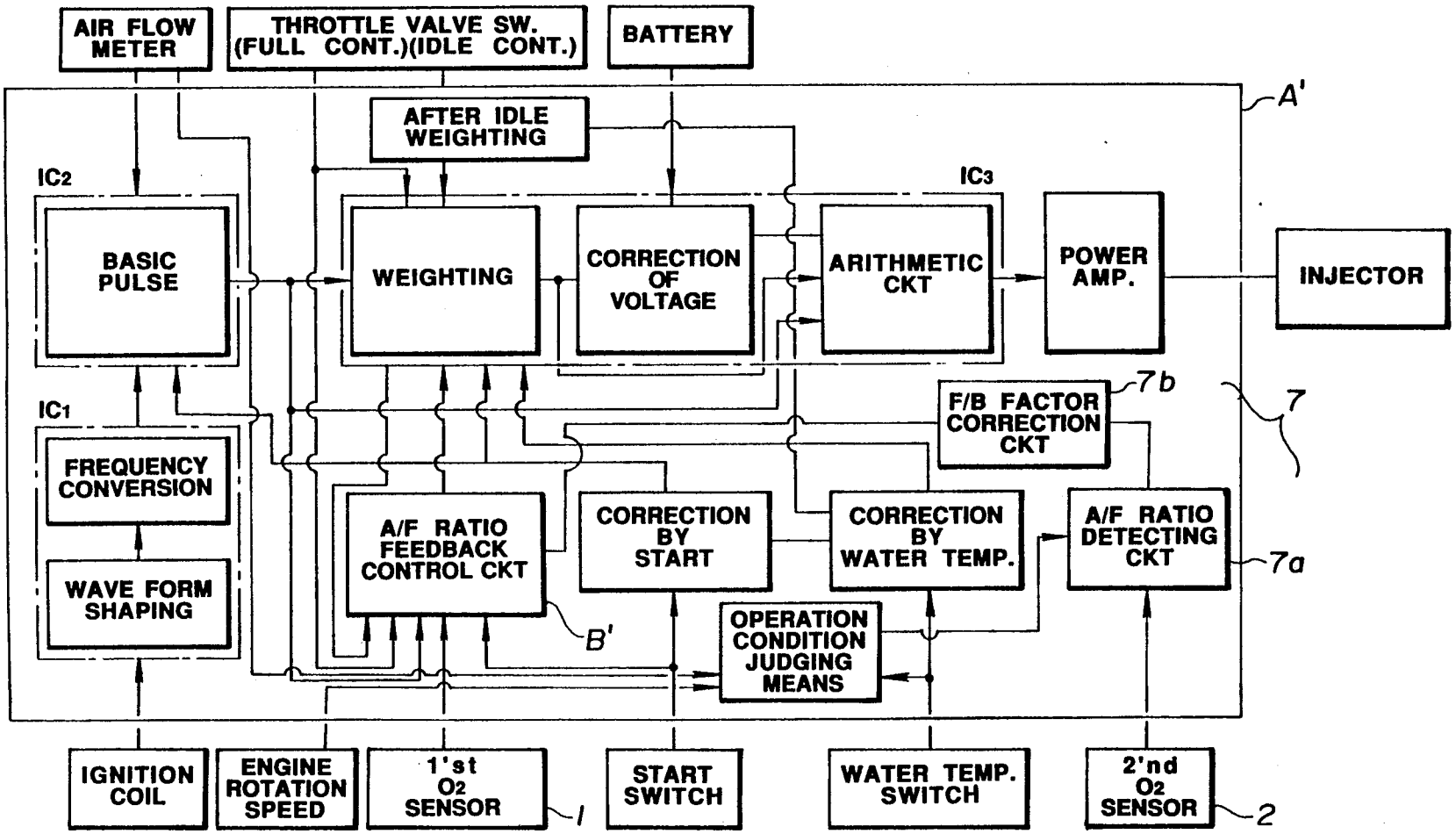
FIG. 12 is a block diagram of the air-fuel ratio control system to which the present invention is practically applied.

The practical air-fuel ratio control for the mixture will be described in the following with reference to FIG. 12 which shows an air-fuel ratio control system.

Figure 16:
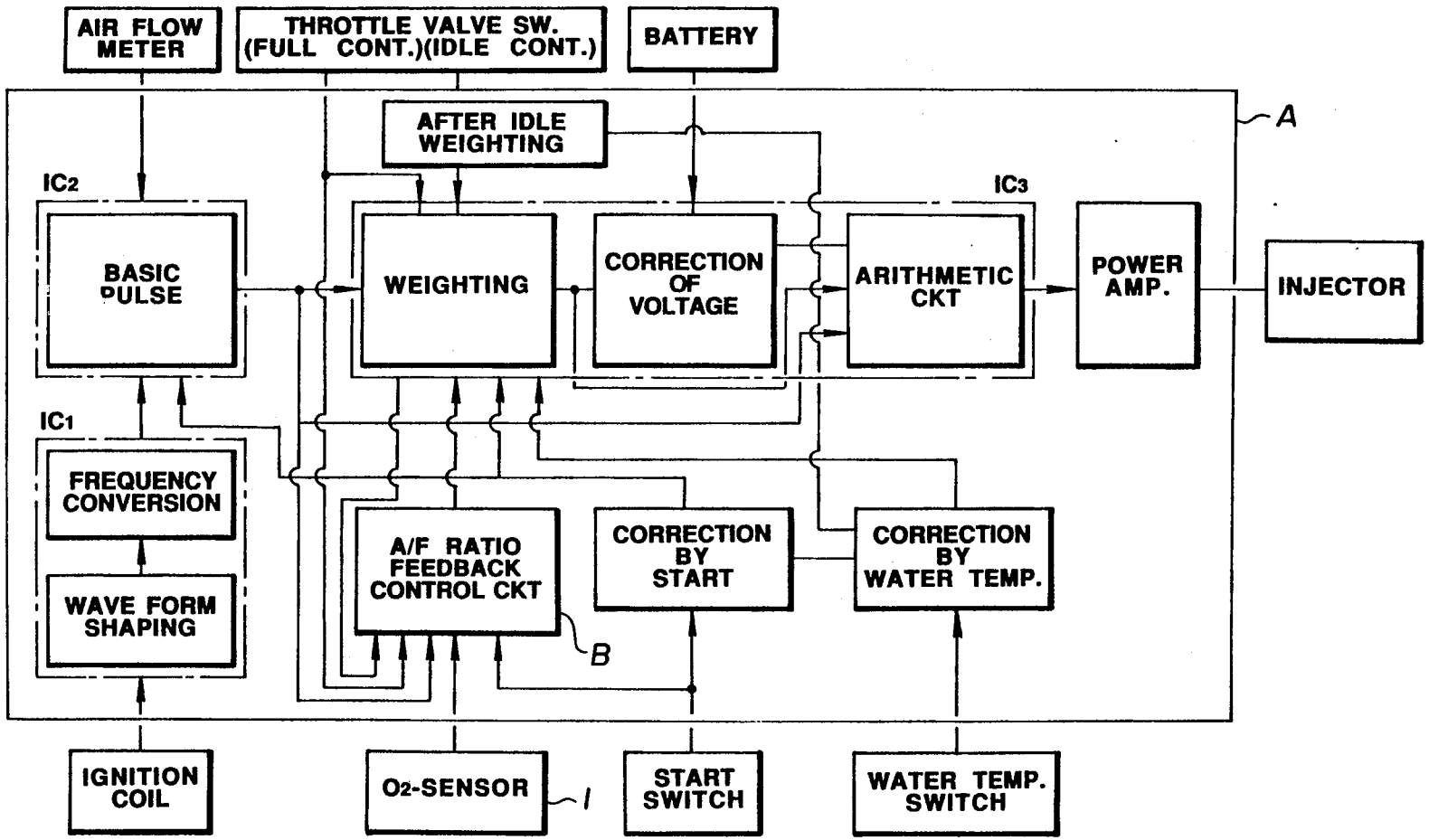
FIG.16 (PRIOR ART)
FIG. 16 is a view similar to FIG. 14, but showing a conventional air-fuel ratio control system.
Figure 17:
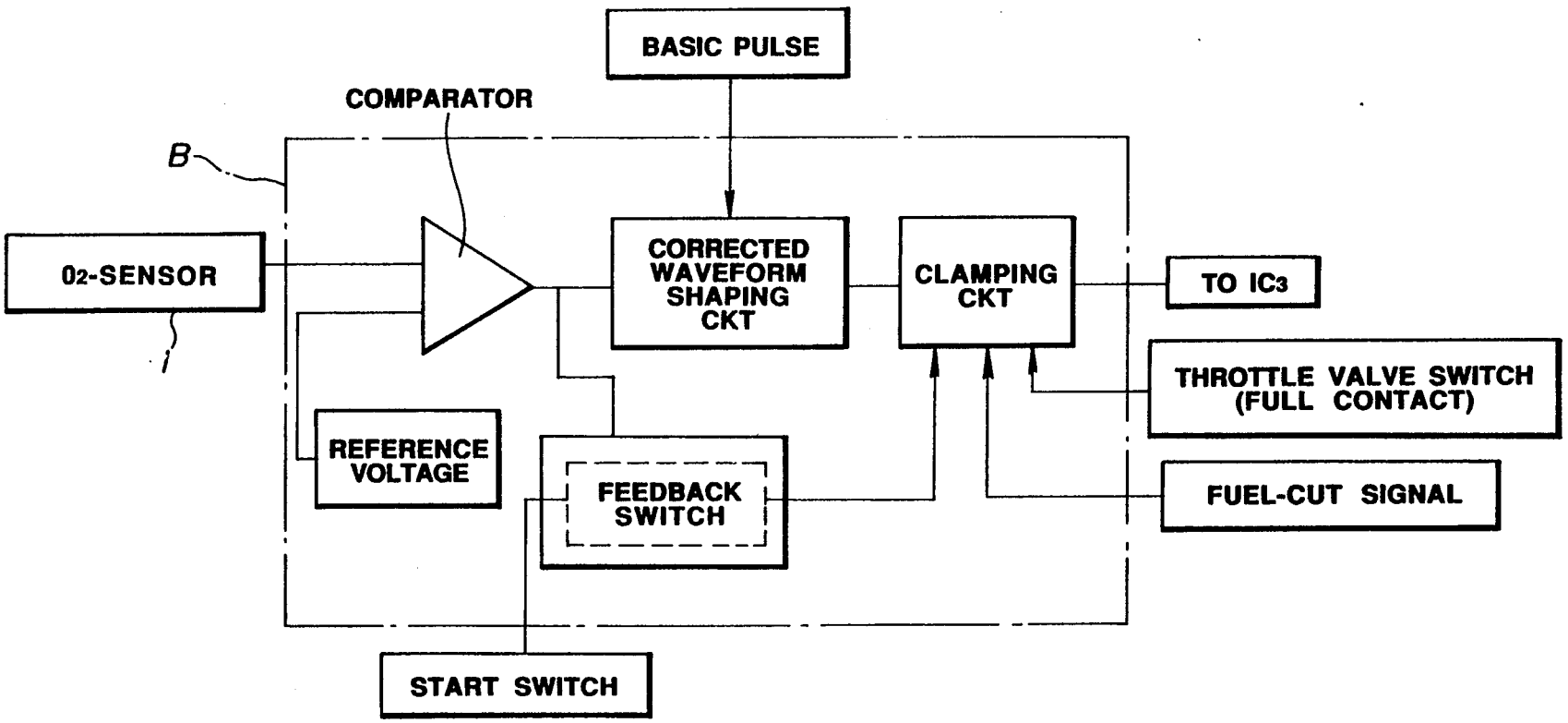
FIG.17 (PRIOR ART)
FIG. 17 is a view similar to FIG. 15, but showing a feedback control circuit employed in the conventional control system of FIG. 16.
Figure 18:
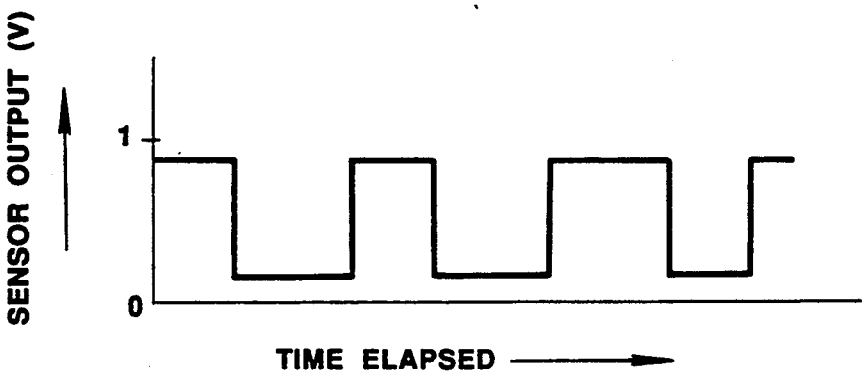
FIG. 18 (PRIOR ART)
FIG. 18 is a chart showing a wave-form of output of an oxygen sensor.
Figure 19:
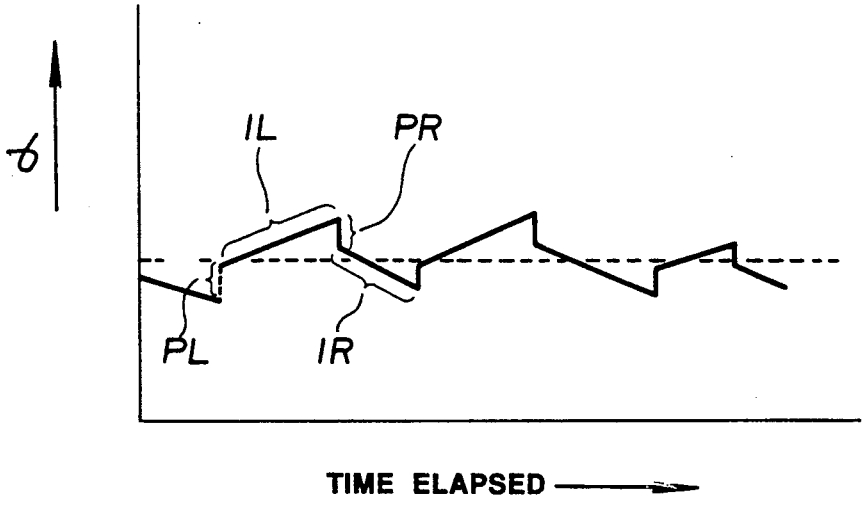
FIG. 19 (PRIOR ART)
FIG. 19 is a chart showing an air-fuel ratio correction factor.

The system is substantially the same as the conventional system of FIG. 16 except the following.

That is, in the invention, the second oxygen sensor 2 and a comparator means 7 which comprises an air-fuel ratio detecting circuit *7a* and a feedback factor correcting circuit *7b* are added, and a modified feedback control circuit "B'" is used as a substitute for the circuit "B".

Figure 13:
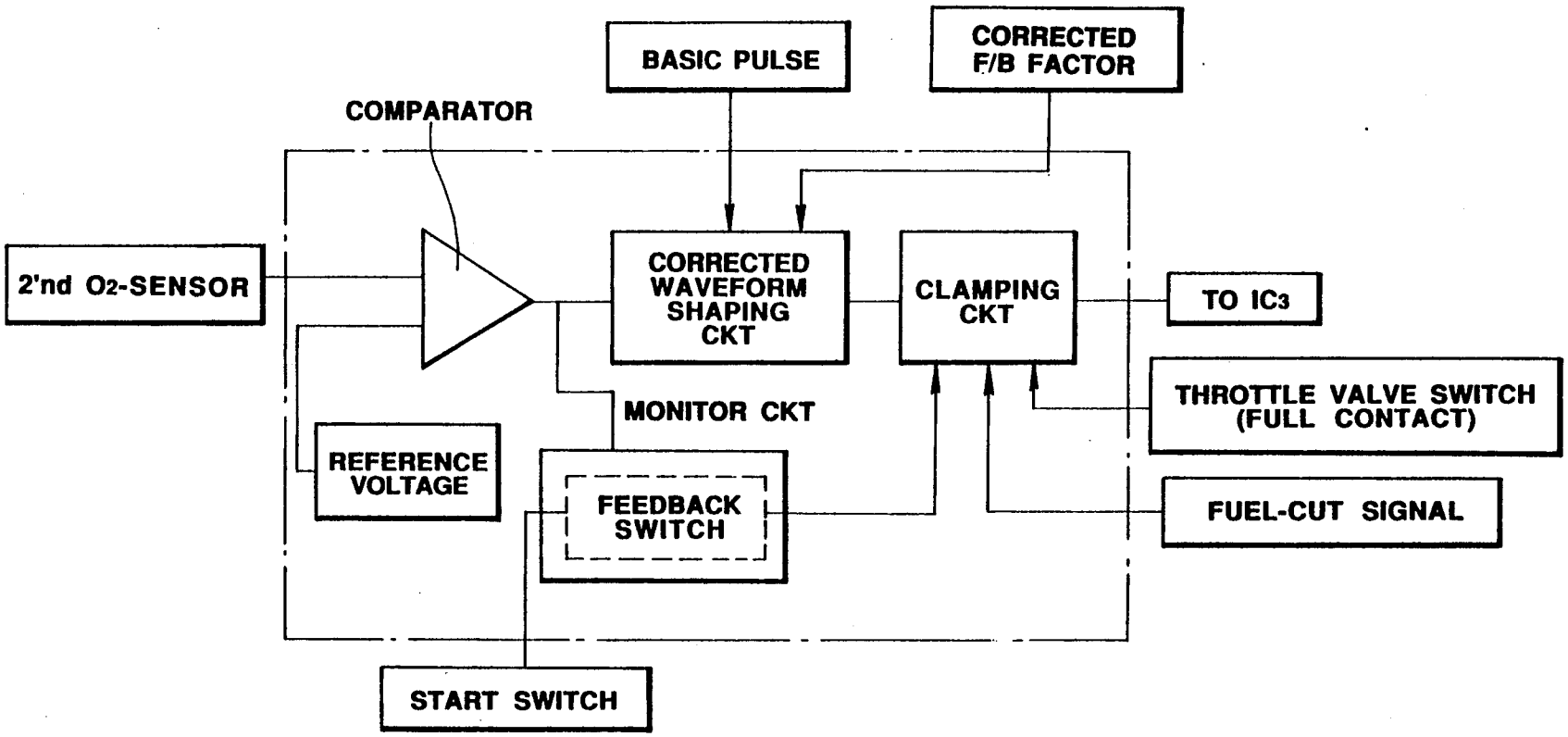
FIG. 13 is a detailed view of a feedback control circuit employed in the air-fuel ratio control system of FIG. 12.

During operation of the engine, the output of the second oxygen sensor 2 is fed through the air-fuel ratio detecting circuit *7a* to the feedback factor correcting circuit *7b* which serves as a so-called "air-fuel ratio correcting means". At this means, the output of the second oxygen sensor 2 is measured for a given time under a certain engine operating condition which is given by the engine condition detecting means. By using the output of the second oxygen sensor 2, correction values for various air-fuel ratio feedback factors are derived. At the air-fuel ratio feedback control circuit B', as is understood from FIG. 13, the correction values are used for forming corrected wave forms with which the basis pulses are corrected.

Figure 14:
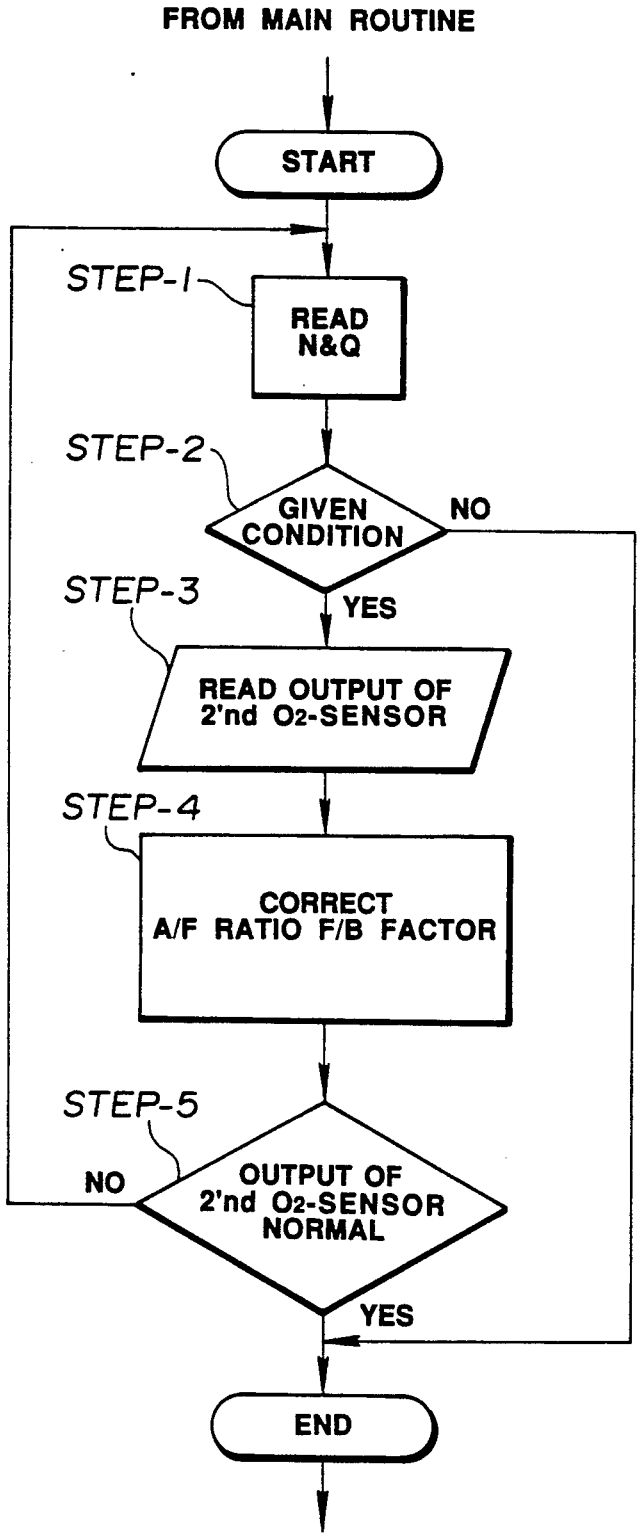
FIG. 14 is a general flowchart showing the outline of operation steps carried out in a control unit employed in the air-fuel ratio control system.

FIG. 14 is a flowchart showing the outline of operation steps carried out in the control unit.

That is, at Step 1, an engine speed "N" and an intake air amount "Q" are read. At Step 2, a judgement as to whether or not the engine condition is the certain condition permitted by the engine condition detecting means is carried out. If Yes, that is, when the engine is under the certain condition, the operation flow goes to Step 3. At this step, the output of the second oxygen sensor 2 is read for a given time. Of course, the output of the sensor 2 is converted to a digital form from an analogue form.

Then, at Step 4, a difference from a desired air-fuel ratio is calculated and the air-fuel ratio feedback factor is corrected in accordance with the difference. This step will be described in detail hereinafter. Then, at Step 5, a judgement as to whether the output of the second oxygen sensor 2 is normal or not is carried out. If Yes, the work at this subroutine is finished.

Figure 15:
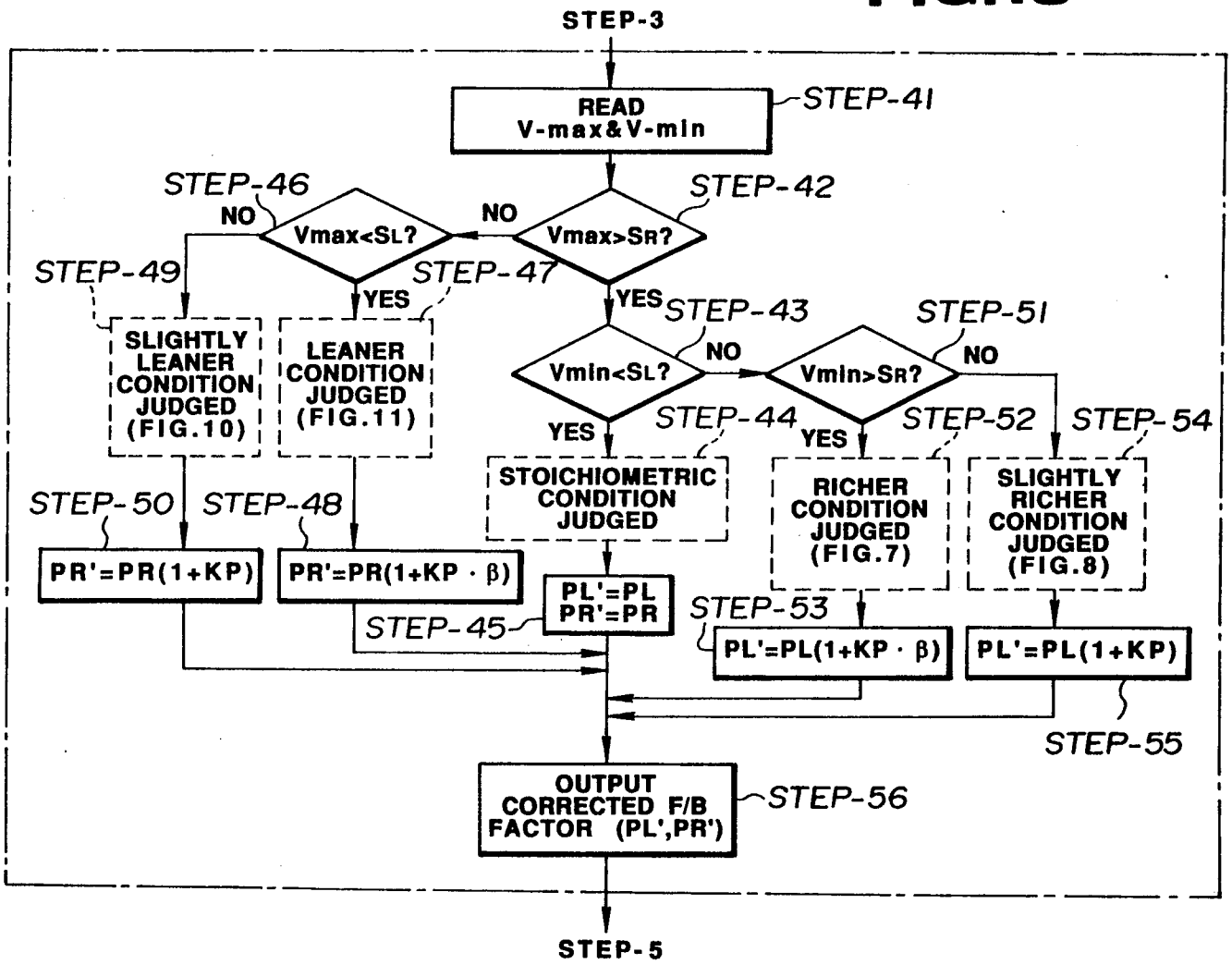
FIG. 15 is a flowchart showing the detail of Step 4 of the general flowchart of FIG. 14.

FIG. 15 shows the detail of Step 4 of the flowchart of FIG. 14.

As the air-fuel ratio feedback factors, proportional factors "P" and integral factors "I" are commonly used. However, in the step 4 of FIG. 15, proportional factors "P" are used, which are corrected in the following manner.

As will become apparent as the description proceeds, in the step 4, a judgement as to whether the output curve of the second oxygen sensor 2 intersects both or one of the slice levels SR and SL or fails to intersect both of them is carried out.

At Step 41, the maximum and minimum values V-max and V-min of the output "V" of the second oxygen sensor 2 are read. At Step 42, a judgement as to whether V-max is greater than SR or not is carried out. If Yes, the operation flow goes to Step 43 where a judgement as to whether V-min is smaller than SL or not is carried out. If Yes, the operation flow goes to Step 44 and it is judged that the air-fuel ratio of the air-fuel mixture is desirable, that is, kept within the stoichiometric level. That is, these steps show the condition of FIG. 9 wherein the output curve of the second oxygen sensor intersects both the slice levels SR and SL. Thus, at Step 45, the proportional factors PL' and PR' are set to the original values PL and PR.

If No at Step 42, the operation flow goes to Step 46. At this step, a judgement as to whether V-max is smaller than SL or not is carried out. If Yes, the operation flow goes to Step 47 and it is judged that the air-fuel ratio of the mixture is leaner than stoichiometric. These steps thus show the condition of FIG. 11 wherein the output curve of the second oxygen sensor 2 is located at the leaner side and fails to intersect both the slice levels SL and SR. Thus, at Step 48, the proportional factor PR' is determined to "PR $(1+Kp\cdot\beta)$" to enrich the air-fuel mixture fed to the engine causing the air-fuel ratio of the mixture to become stoichiometric as soon as possible.

If No at Step 46, the operation flow goes to Step 49 and it is judged that the air-fuel ratio of the mixture is slightly leaner than stoichiometric. These steps thus show the condition of FIG. 10 wherein the output curve of the second oxygen sensor 2 intersects only the slice level SL. Thus, at Step 50, the proportional factor PR' is determined to "PR $(1+Kp)$" to somewhat enrich the air-fuel mixture causing the air-fuel ratio of the mixture to become stoichiometric soon.

If No at Step 43, the operation flow goes to Step 51. At this step, a judgement as to whether V-min is greater than SR or not is carried out. If Yes, the operation flow goes to Step 52 and it is judged that the air-fuel ratio of the mixture is richer than stoichiometric. These steps show the condition of FIG. 7 wherein the output curve of the second oxygen sensor 2 is located at the richer side and fails to intersect both the slice levels SR and SL. Thus, at Step 53, the proportional factor PL' is determined to "PL $(1+Kp\cdot\beta)$" to lean the air-fuel mixture fed to the engine causing the air-fuel ratio of the mixture to become stoichiometric as soon as possible.

If No at Step 51, the operation flow goes to Step 54 and it is judged that the air-fuel ratio of the mixture is somewhat richer than stoichiometric. These steps thus show the condition of FIG. 8 wherein the output curve of the second oxygen sensor 2 intersects only the slice level SR. Thus, at Step 55, the proportional factor PL' is determined to $PL(1+Kp)$ to somewhat lean the air-fuel mixture fed to the engine causing the air-fuel ratio of the mixture to become stoichiometric soon.

After the above-mentioned judgement is carried out, the corrected proportional factors PL' and PR' are outputted at Step 56. The operation flow then goes to Step 5 of the flowchart of FIG. 14.

The above-mentioned five judgements will be itemized in the following.

$$PL' = PL,\ PR' = PR \quad \text{Normal,} \tag{1}$$

$$PL' = PL(1 + Kp \cdot \beta) \quad \text{Richer than Stoichiometric,} \tag{2}$$

-continued $$PL' = PL(1 + Kp) \quad \text{Slightly richer than Stoichiometric,} \tag{3}$$

$$PR' = PR(1 + Kp) \quad \text{Slightly leaner than Stoichiometric,} \tag{4}$$

and $$PR' = PR(1 + Kp \cdot \beta) \quad \text{Leaner than Stoichiometric.} \tag{5}$$

As will be understood from the above description, in the present invention, the leaner and richer air-fuel supply to the engine, which may be caused by deterioration of the first oxygen sensor, is detected by the second oxygen sensor. The air-fuel ratio feedback factors (viz., the proportional factors PL and PR) are corrected in accordance with the information signals issued from the second oxygen sensor and, the fuel injectors are controlled in accordance with the corrected feedback factors. That is, when the second oxygen sensor detects a richer or leaner condition of the air-fuel mixture (which may be caused by deterioration of the first oxygen sensor), the control unit issues command signals to the fuel injectors until the mixture becomes to have a stoichiometric air-fuel ratio, that is, until the second oxygen sensor exhibits an output characteristic which is similar to that of the first oxygen sensor.

What is claimed is:

1. In a feedback type air-fuel ratio control system which controls the air-fuel ratio of air-fuel mixture fed to an internal combustion engine in accordance with an information signal issued from a first oxygen sensor installed in an exhaust line of said engine, said exhaust line having a catalytic converter mounted thereto at a position downstream of said first oxygen sensor, a combination which comprises:

a second oxygen sensor installed in said exhaust line at a position upstream of said catalytic converter, said second oxygen sensor being of a delayed response type;

first means for defining higher and lower slice levels with respect to the output of said second oxygen sensor; and second means for detecting deterioration of said first oxygen sensor by comparing the output of said second oxygen sensor with said higher and lower slice levels.

2. A system as claimed in claim 1, in which said higher and lower slice levels are positioned at higher and lower output sides of said second oxygen sensor with respect to an output of the sensor which is produced when the air-fuel mixture has a stoichiometric air-fuel ratio.

3. A system as claimed in claim 2, in which said second means comprises:

means for reading maximum and minimum levels of the output of said second oxygen sensor; and means for judging the condition of said first oxygen sensor by finding one of five states, said five states being:

(a) a state wherein said maximum level is higher than said higher slice level and said minimum level is lower than said lower slice level;

(b) a state wherein said maximum level is lower than said lower slice level;

(c) a state wherein said maximum level is lower than said higher slice level and higher than said lower slice level;

(d) a state wherein said minimum level is higher than said higher slice level; and (e) a state wherein said minimum level is lower than said higher slice level and higher said lower slice level.

4. A system as claimed in claim 3, further comprising third means which controls the air-fuel ratio of air-fuel mixture in accordance with an information from said second means.

5. A system as claimed in claim 4, in which said third means enriches the air-fuel mixture when said second means finds the states (b) and (c) and leans the air-fuel mixture when said second means finds the states (d) and (e).

6. A system as claimed in claim 5, in which said third means keeps the existing air-fuel ratio of the mixture when said second means finds the state (a).

7. A system as claimed in claim 1, in which said second oxygen sensor comprises a base structure of zirconia, first and second platinum electrodes lines on respective surfaces of said base structure, a spinel layer lined on said second electrode and a catalyst layer lined on said spinel layer, said catalyst layer including noble metals and ceria.

8. In a feedback type air-fuel ratio control system which controls the air-fuel ratio of air-fuel mixture fed to an internal combustion engine in accordance with an information signal issued from a first oxygen sensor installed in an exhaust line of said engine, said exhaust line having a catalytic converter mounted thereto at a position downstream of said first oxygen sensor, method of detecting deterioration of said first oxygen sensor, which comprises by steps:

monitoring the air-fuel ratio of the mixture by receiving an information signal from a second oxygen sensor installed in said exhaust line at a position upstream of said catalytic converter, said second oxygen sensor being of a delayed response type;

defining higher and lower slice levels with respect to the output of said second oxygen sensor; and comparing the output of said second oxygen sensor with said higher and lower slice levels.

9. A method as claimed in claim 8, further comprising:

controlling the air-fuel ratio of the mixture in accordance with a result of the comparison of said output with said higher and lower slice levels.

10. A feedback type air-fuel ratio control system of an internal combustion engine which is equipped with a catalytic converter at an exhaust line, said system comprising:

a first oxygen sensor installed in the exhaust line at a position upstream of said catalytic converter;

control means for controlling the air-fuel ratio of air-fuel mixture fed to the engine in accordance with an information signal issued from said first oxygen sensor;

a second oxygen sensor installed in said exhaust line at a position upstream of said catalytic converter, said second oxygen sensor being of a delayed response type;

first means for defining higher and lower slice levels with respect to the output of said second oxygen sensor;

second means for detecting deterioration of said first oxygen sensor by comparing the output of said second oxygen sensor with said higher and lower slice levels; and third means for modifying said information signal of said first oxygen sensor in accordance with an information from said second means.

* * * * *